US012420172B1

(12) United States Patent
Williams

(10) Patent No.: US 12,420,172 B1
(45) Date of Patent: Sep. 23, 2025

(54) GEOMETRIC PUZZLES

(71) Applicant: Angela S. Williams, Texarkana, TX (US)

(72) Inventor: Angela S. Williams, Texarkana, TX (US)

( * ) Notice: Subject to any disclaimer, the term of this patent is extended or adjusted under 35 U.S.C. 154(b) by 183 days.

(21) Appl. No.: 18/372,352

(22) Filed: Sep. 25, 2023

(51) Int. Cl.
*A63F 9/08* (2006.01)

(52) U.S. Cl.
CPC ..... *A63F 9/0838* (2013.01); *A63F 9/0865* (2013.01); *A63F 2009/0849* (2013.01); *A63F 2009/0853* (2013.01)

(58) Field of Classification Search
CPC ..... A63F 9/0838; A63F 9/0865; A63F 2009/0849; A63F 2009/0853
See application file for complete search history.

(56) References Cited

U.S. PATENT DOCUMENTS 4,416,453 A * 11/1983 Sasso ..... A63F 9/0838 273/153 S
4,473,228 A * 9/1984 Hart ..... A63F 9/0838 380/57
4,474,376 A * 10/1984 Gustafson ..... A63F 9/0838 273/153 S
4,529,201 A * 7/1985 Nadel ..... A63F 9/0838 273/153 S
4,575,088 A * 3/1986 Peek ..... A63F 9/0838 273/153 S
5,308,066 A 5/1994 Pataki et al.
5,344,148 A 9/1994 Asch
5,386,993 A 2/1995 Apsan
5,566,941 A 10/1996 Destics
5,816,571 A 10/1998 Chen
5,836,584 A 11/1998 Chen
6,398,221 B1 6/2002 Graham
6,422,559 B1 7/2002 Utkin
6,857,632 B2 2/2005 Tanner
8,109,515 B2 2/2012 Fedoseyev et al.
10,543,421 B1 1/2020 Smith
2003/0030212 A1 2/2003 Blazek et al.
(Continued)

FOREIGN PATENT DOCUMENTS

CN 111558216 A * 8/2020
DE 3149316 A1 * 6/1983
GB 2101491 A * 1/1983 ..... A63F 9/0838
(Continued)

*Primary Examiner* — Steven B Wong
(74) *Attorney, Agent, or Firm* — R. Keith Harrison

(57) ABSTRACT

Geometric puzzles may include a puzzle core. A puzzle faces may be provided on the puzzle core. Each puzzle face may include a puzzle piece guide. The puzzle piece guide may form a central axis of rotation of each corresponding puzzle face. Puzzle pieces supported by the puzzle core may be concentrically arranged around, detachably engage, and revolvable about the puzzle piece guide. At least one visual pattern may be provided on each puzzle piece. The puzzle faces may each be rotatable by revolving the puzzle pieces about the puzzle piece guide of each corresponding puzzle face to transfer or exchange at least one of the puzzle pieces among or between the puzzle faces and attain selected combinations of the visual patterns on the puzzle pieces in each puzzle face for scrambling or matching of the visual patterns on the puzzle pieces in each puzzle face.

18 Claims, 11 Drawing Sheets

(56) References Cited

U.S. PATENT DOCUMENTS

| | | | | |
|---|---|---|---|---|
| 2008/0230988 | A1* | 9/2008 | Paquette | A63F 9/0838<br>273/153 R |
| 2022/0203220 | A1 | 6/2022 | Bodytko | |

FOREIGN PATENT DOCUMENTS

| | | | | | |
|---|---|---|---|---|---|
| GB | 2107595 | A * | 5/1983 | ..... | A63F 9/0838 |
| WO | WO-8203564 | A1 * | 10/1982 | | |
| WO | WO2003105978 | | 12/2003 | | |
| WO | WO-2007063151 | A1 * | 6/2007 | ..... | A63F 9/0838 |

* cited by examiner

GEOMETRIC PUZZLES

FIELD

Illustrative embodiments of the disclosure relate to games and puzzles. More particularly, illustrative embodiments of the disclosure relate to geometric puzzles having puzzle pieces concentrically arranged in one of a plurality of independently rotatable puzzle faces each of which forms a corresponding face of a polyhedron. At least one alphabetical, numerical, symbolic, pictorial, color and/or other visual pattern may be provided on each puzzle piece. The puzzle pieces can be revolved about a central axis of rotation of each corresponding puzzle face as the puzzle faces are sequentially rotated to transfer or exchange the puzzle pieces among or between the puzzle faces and obtain different combinations of the visual patterns on the puzzle pieces in each puzzle face for scrambling or matching of the visual patterns in the puzzle faces.

SUMMARY

Illustrative embodiments of the disclosure are generally directed to geometric puzzles. An illustrative embodiment of the geometric puzzles may include a puzzle core. A plurality of independently rotatable puzzle faces may be provided on the puzzle core. Each puzzle face may include a puzzle piece guide supported by the puzzle core. The puzzle piece guide may form a central axis of rotation of each corresponding puzzle face. A plurality of puzzle pieces may be supported by the puzzle core. The puzzle pieces may be concentrically arranged around, detachably engage, and revolvable about the puzzle piece guide. At least one visual pattern may be provided on each puzzle piece. The puzzle faces may each be rotatable by revolving the puzzle pieces about the puzzle piece guide of each corresponding puzzle face to transfer or exchange at least one of the puzzle pieces among or between the puzzle faces and attain selected combinations of the visual patterns on the puzzle pieces in each puzzle face for scrambling or matching of the visual patterns on the puzzle pieces in each puzzle face.

In another aspect, each of the puzzle faces may form a corresponding face of a polyhedron.

In another aspect, the polyhedron may include a dodecahedron and the puzzle faces may include twelve independently rotatable puzzle faces.

In another aspect, the puzzle pieces in each puzzle face may include five triangular puzzle pieces.

In another aspect, the puzzle piece guide may include a guide member mount post supported by the puzzle core and a guide member supported by the guide member mount post, and each puzzle piece may be configured to detachably engage the guide member.

In another aspect, a guide member cavity may be provided in the guide member, and each puzzle piece may detachably engage the guide member cavity.

In another aspect, a plurality of guide legs may be provided on each puzzle piece, and one of the guide legs may detachably engage the guide member cavity.

In another aspect, the visual pattern may include at least one alphabetical, numerical, symbolic, pictorial, or color visual pattern.

These and other features of the geometric puzzles will become more readily apparent from the attached drawings and the detailed description of various illustrative embodiments, which follow.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
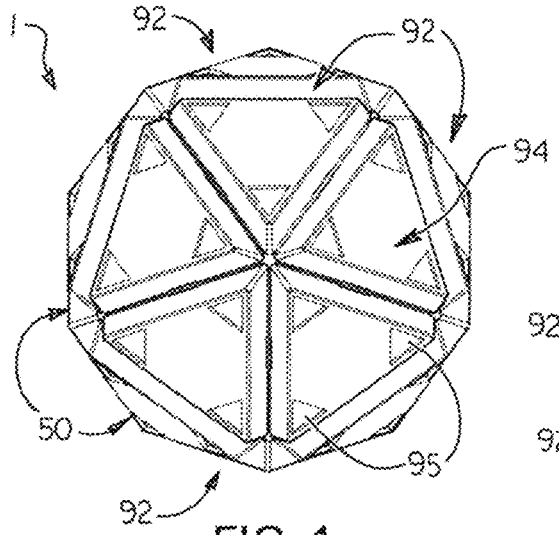
FIG. 1 is a front view of an illustrative dodecahedral embodiment of the geometric puzzles, with twelve groups of five triangular puzzle pieces all sharing a common face corresponding to the face of a dodecahedron, each puzzle face consisting of the 5 grouped puzzle pieces disposed in a resting position on the puzzle.
Figure 2:
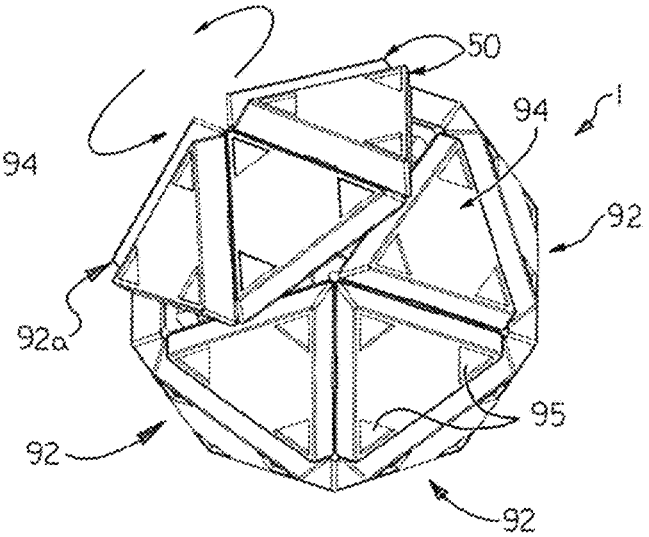
FIG. 2 is a front view of the illustrative geometric puzzle illustrated in FIG. 1, with a puzzle face on a left-hand side of the geometric puzzle in a rotated position between a first resting position and a second resting position of the puzzle face.
Figure 3:
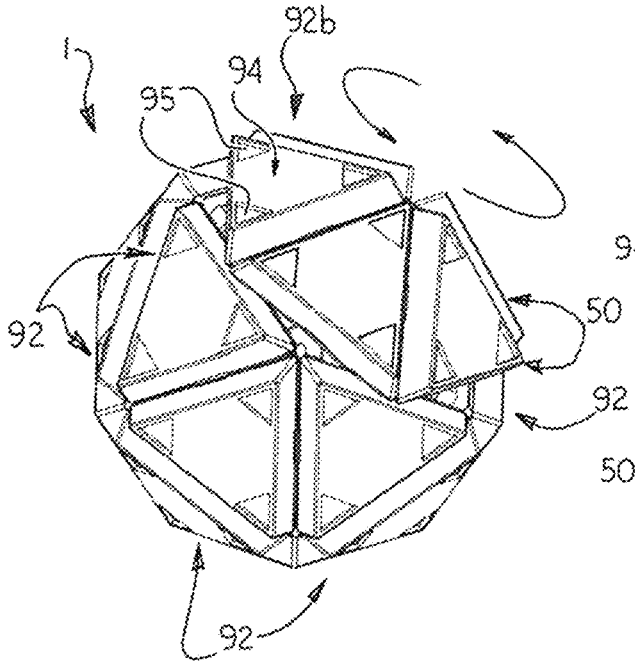
FIG. 3 is a front view of the illustrative geometric puzzle illustrated in FIG. 1, with a puzzle face on a right-hand side of the geometric puzzle in a rotated position between first and second resting positions.
Figure 4:
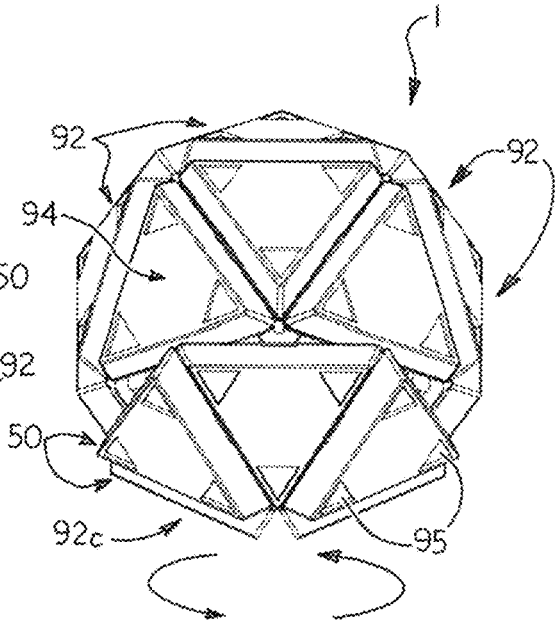
FIG. 4 is a front view of the illustrative geometric puzzle illustrated in FIG. 1, with a puzzle face on the bottom of the geometric puzzle in a rotated position between first and second resting positions.
Figure 5:
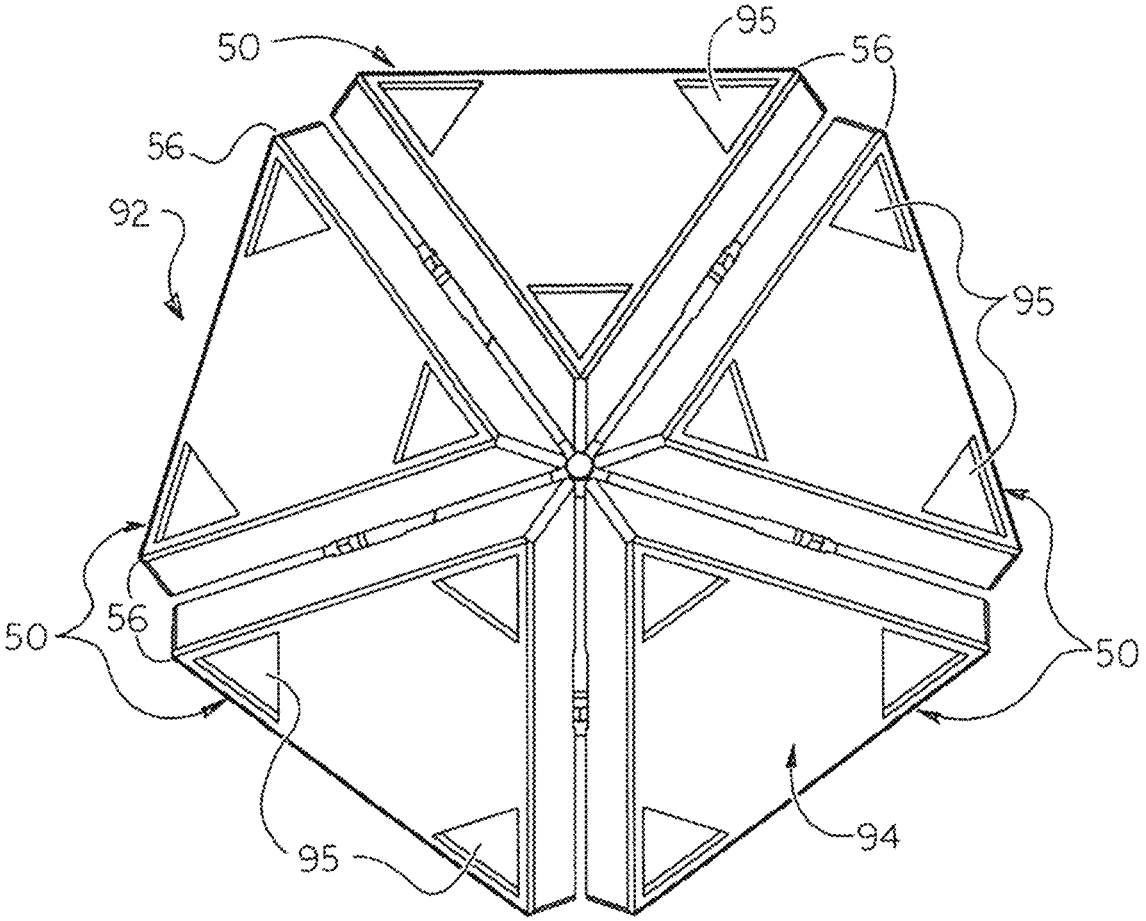
FIG. 5 is an enlarged front view of an exemplary puzzle face of the illustrative geometric puzzle illustrated in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the subject matter as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition term "comprise" or "comprises" means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment.

Unless otherwise noted using precise or limiting terminology, all numbers which express quantities of ingredients throughout the specification and claims are to be understood as being approximations of the numerical value cited to express the quantities of those ingredients. As used throughout the specification and claims, the term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

Figure 26:
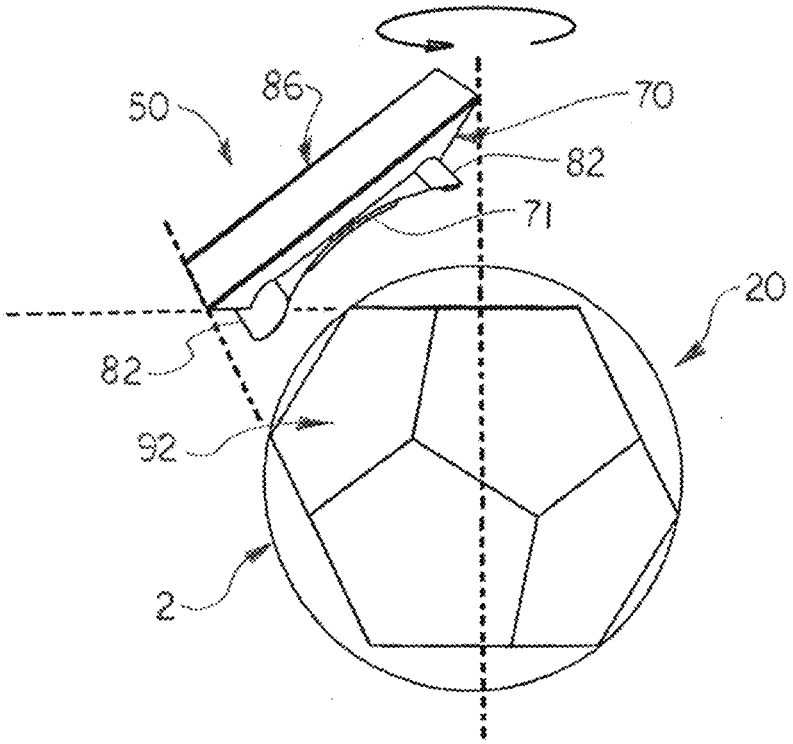
FIG. 26 is an exploded view of the illustrative geometric puzzle illustrating how the puzzle pieces relate to the abstract dodecahedron superimposed on the puzzle core.

Referring to the drawings, an illustrative embodiment of the geometric puzzles is generally indicated by reference numeral 1 in FIGS. 1-4. As illustrated in FIGS. 1-6, the geometric puzzle 1 may have a plurality of puzzle pieces 50 arranged in one of a plurality of independently rotatable puzzle faces 92. In some embodiments, each of the puzzle faces 92 may form a corresponding face of a polyhedron. For example and without limitation, in some embodiments, the puzzle faces 92 may be twelve in number and may generally form the respective faces of an abstract dodecahedron 20 (FIG. 26). In some embodiments, the puzzle faces 92 of the geometric puzzle 1 may form a spherical or other three-dimensional geometric shape.

At least one visual pattern 94 may be provided on each puzzle piece 50. Each visual pattern 94 may include at least one alphabetical, numerical, symbolic, pictorial, color and/or other visual pattern. For example and without limitation, as illustrated in FIGS. 1-6, in some embodiments, the visual pattern 94 may include a plurality of tabs 95 which may be distinguishable from each other by color, number, and/or other visual characteristic(s). In some applications, a goal of solving the geometric puzzle 1 may be to match the initially scrambled or dispersed and unmatched tabs 95 on the puzzle pieces 50 in each puzzle face 92 according to like visual characteristics, typically as will be hereinafter described.

Figure 6:
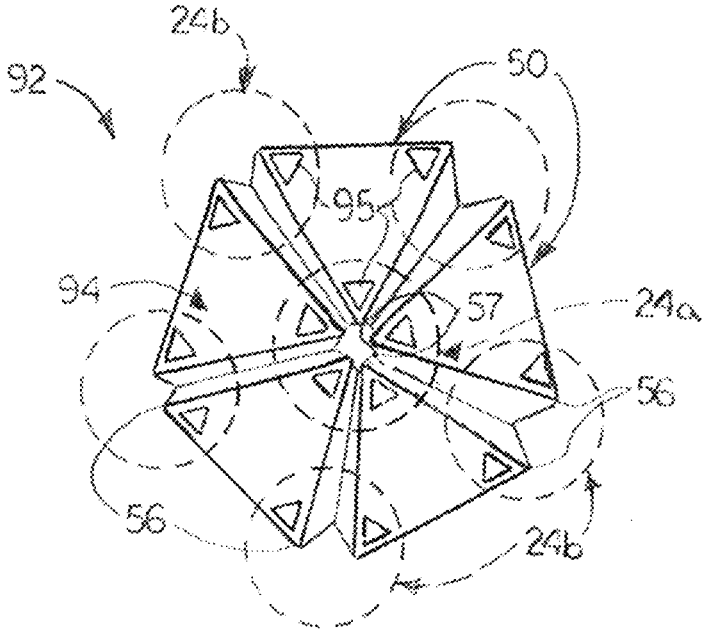
FIG. 6 is a front view of the exemplary puzzle face, with each puzzle piece in the puzzle face engaging and configured to revolve around three puzzle piece guides (illustrated in phantom) each of which forms a central axis of rotation of a corresponding puzzle face and a visual pattern having multiple triangular tabs at the respective vertices of each puzzle piece.
Figure 10:
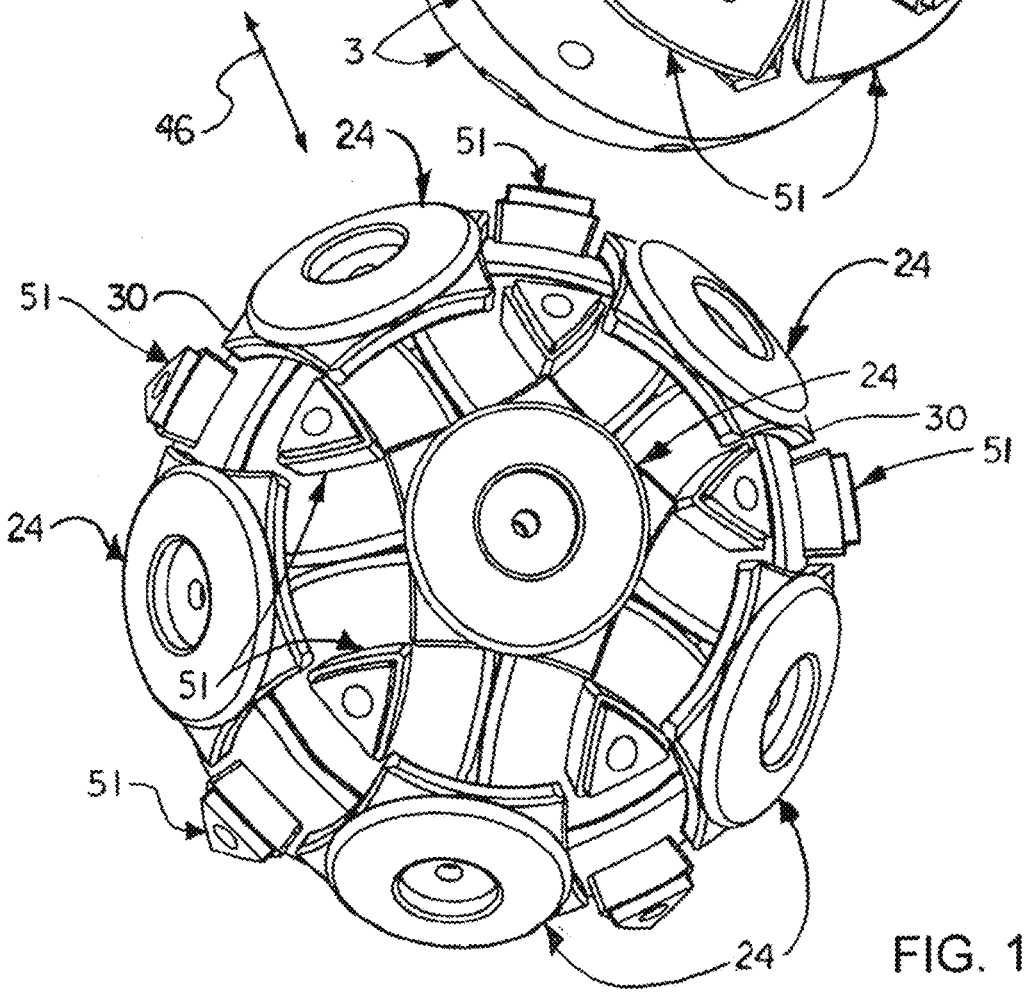
FIG. 10 is a perspective view illustrating a plurality of puzzle piece guides assembled on the puzzle core with the puzzle piece bases of the respective partially assembled puzzle pieces engaging each corresponding puzzle piece guide.
Figure 24:
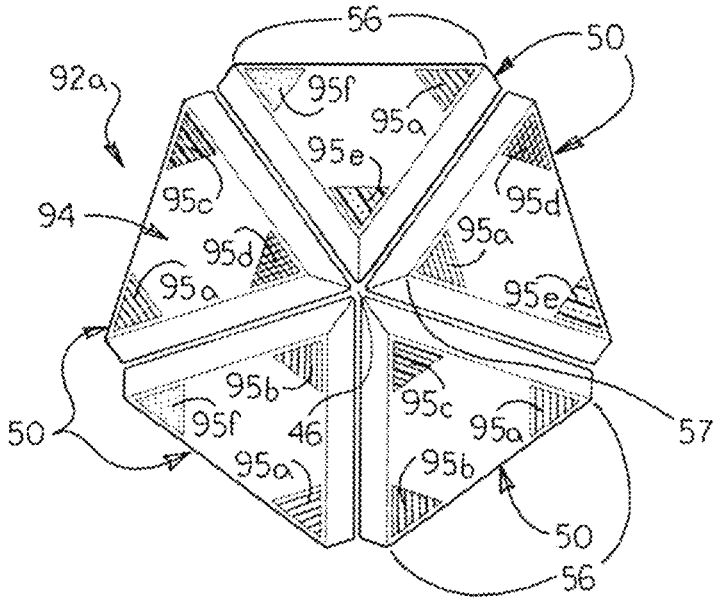
FIG. 24 is a front view of a puzzle face of the illustrative geometric puzzle with the puzzle pieces in the puzzle face disposed in the resting position and the tabs in the visual patterns on the puzzle pieces in a scrambled, dispersed, or unmatched configuration.
Figure 25:
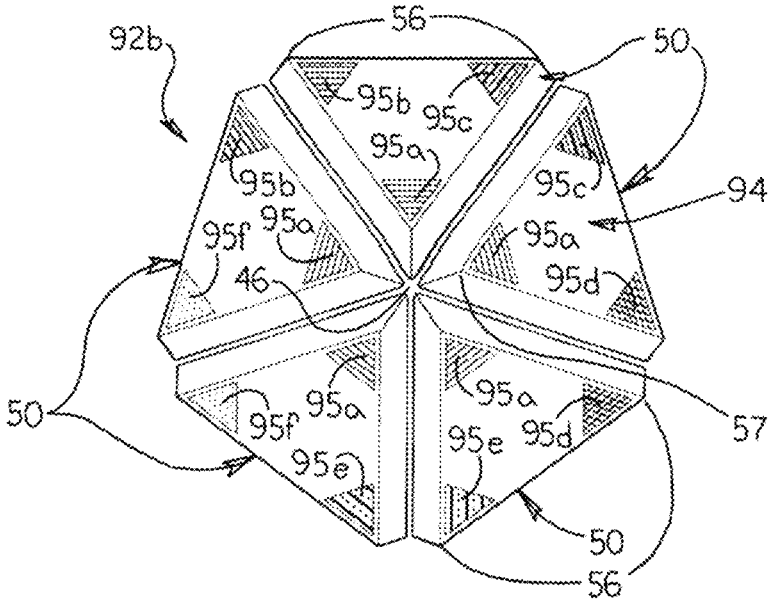
FIG. 25 is a front view of a new puzzle face obtained by revolving the puzzle pieces of the puzzle face illustrated in FIG. 24 about a central axis of rotation of the puzzle face and thereby transferring or exchanging the puzzle pieces among other puzzle faces in the geometric puzzle, with the new puzzle face formed by the puzzle pieces having matching tabs in the visual patterns on the puzzle pieces.

As illustrated in FIGS. 1-4 and will be hereinafter described, the puzzle pieces 50 can be selectively revolved about a central axis of rotation 46 (FIG. 10) of each corresponding puzzle face 92 as the puzzle faces 92 are individually, sequentially, and incrementally rotated to transfer or exchange the puzzle pieces 50 among or between the puzzle faces 92. In this manner, different combinations of the visual patterns 94 on the puzzle pieces 50 in each puzzle face 92 typically for initial scrambling and then matching of the visual patterns 94 on the puzzle faces 92 can be attained. As illustrated in FIGS. 6, 24 and 25, each puzzle piece 50 in each puzzle face 92 may have a pair of outer puzzle piece vertices 56 at the outside of the puzzle face 92 and an inner puzzle piece vertex 57 at the center of the puzzle face 92. Each puzzle face 92 may be rotated by incremental movement of the puzzle pieces 50 in concert with each other in a revolving circular path about the axis of rotation 46 between resting and rotated positions of each puzzle piece 50, typically as will be hereinafter described.

Figure 7:
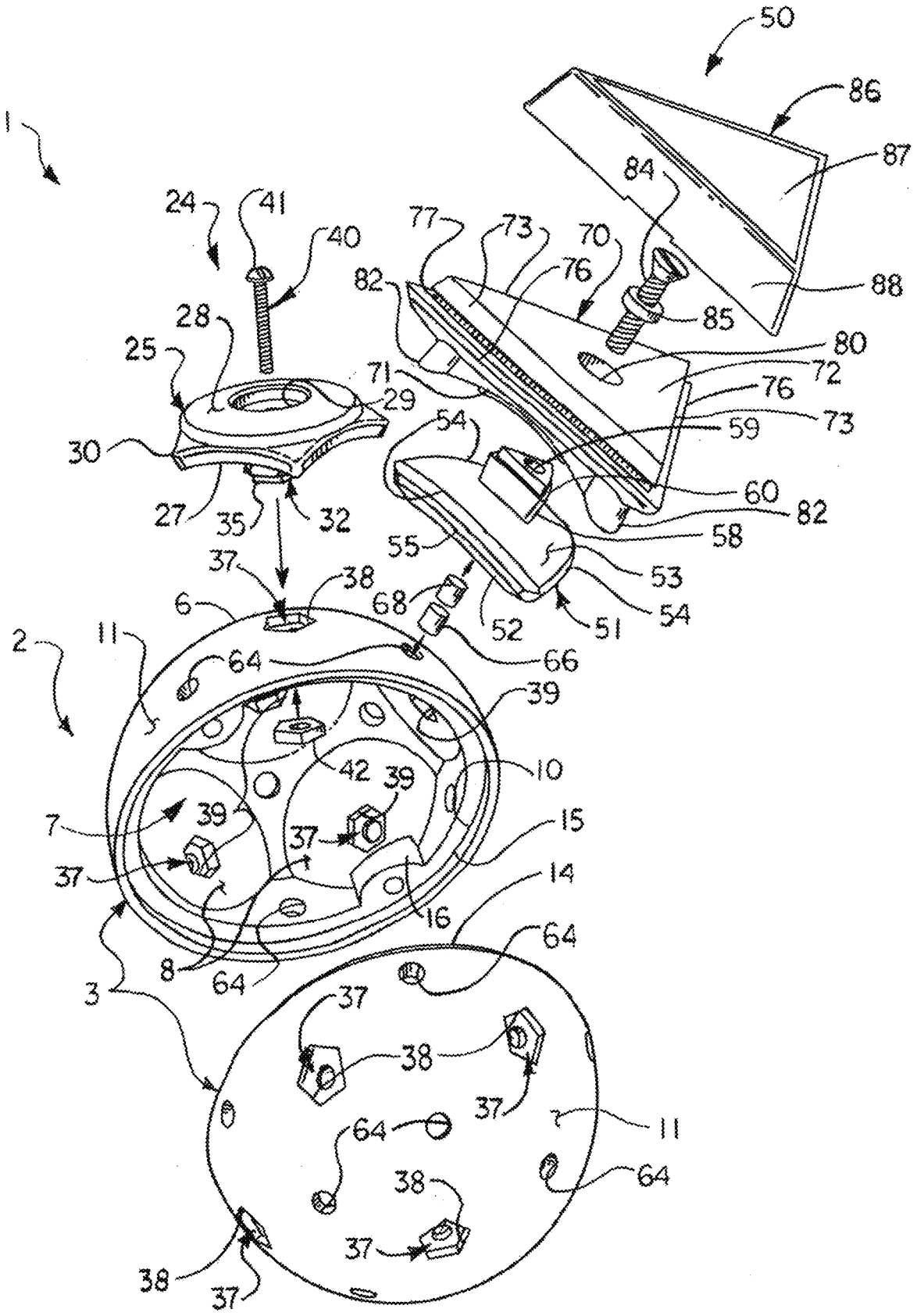
FIG. 7 is an exploded top perspective view illustrating a typical design for a puzzle core, each puzzle piece guide and each puzzle piece of the illustrative geometric puzzle.
Figure 8:
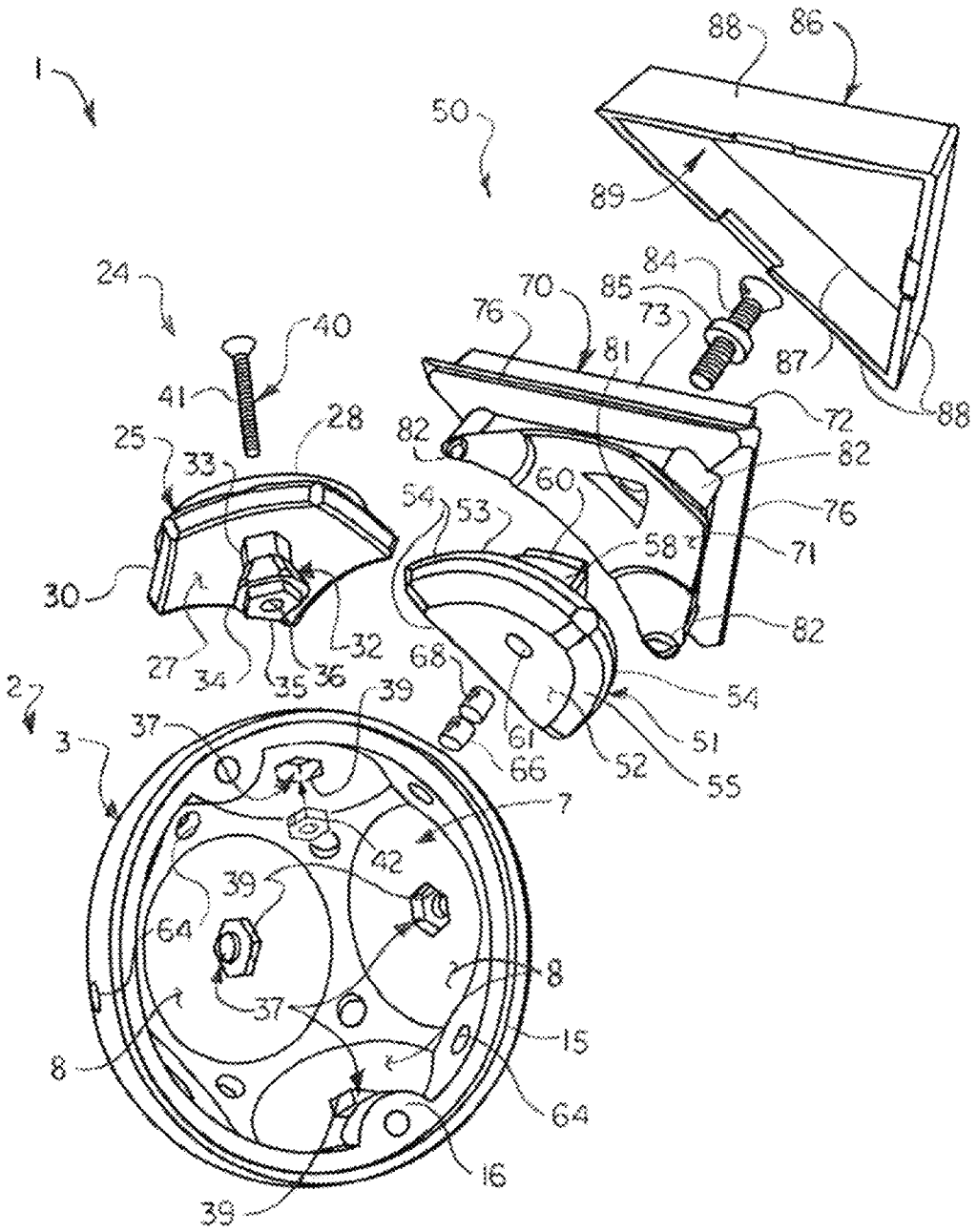
FIG. 8 is an exploded bottom perspective view of a hemispherical core subunit of the puzzle core, each puzzle piece guide and each puzzle piece of the illustrative geometric puzzle illustrated in FIG. 7.
Figure 9:
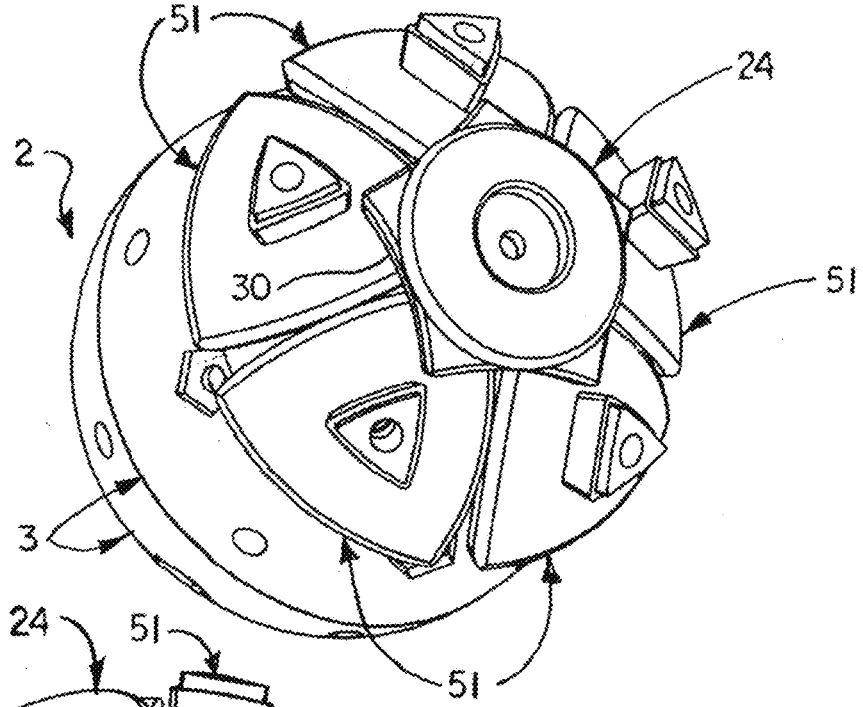
FIG. 9 is a perspective view of the puzzle core, a puzzle piece guide assembled on the puzzle core and puzzle piece bases of a respective plurality of partially assembled puzzle pieces engaging the puzzle piece guide, which puzzle pieces will correspond to a puzzle face of the geometric puzzle in the assembled puzzle pieces.

As illustrated in FIGS. 7 and 8, the geometric puzzle 1 may include a puzzle core 2. The puzzle faces 92 (FIGS. 1-5) may be provided on the puzzle core 2. Each puzzle face 92 may include a center puzzle piece guide 24 (indicated by reference numeral 24*a* in FIG. 6) supported by the puzzle core 2. Each puzzle piece guide 24 may form the central axis of rotation 46 (FIG. 10) of its corresponding puzzle face 92. The puzzle pieces 50 of each puzzle face 92 may be supported by the puzzle core 2, typically in a manner which will be hereinafter described. The puzzle pieces 50 may detachably engage and be configured to be revolved about the puzzle piece guide 24 to facilitate rotation of each corresponding puzzle face 92, typically as will be hereinafter described. The puzzle faces 92 may be sequentially and incrementally rotated by manually revolving the puzzle pieces 50 of each puzzle face 92 about the central puzzle piece guide 24 of the puzzle face 92 in either direction to transfer or exchange at least one of the puzzle pieces 50 among or between the puzzle faces 92 and attain selected combinations of the visual pattern or patterns 94 on the puzzle pieces 50 in each corresponding puzzle face 92. In this manner, the visual pattern or patterns 94 on the puzzle pieces 50 in each puzzle face 92 may be selectively scrambled or dispersed among the puzzle faces 92 and then matched to achieve a desired goal or outcome such as forming a composite picture on one or more of the puzzle faces 92 or on the geometric puzzle 1 as a whole, or to achieve colored, numerical, patterned, and/or other matching of the visual patterns 94 on the puzzle pieces 50 of each puzzle face 92, for example and without limitation.

As illustrated in FIG. 26, in some embodiments, the polyhedral geometric puzzle 1 may generally form an abstract dodecahedron 20 with twelve puzzle faces 92 generally corresponding to the respective twelve pentagonal planes or faces of the abstract dodecahedron 20. In other embodiments, the polyhedral puzzle 1 may be an alternative polyhedron with the number of puzzle faces 92 less or greater than twelve. In some embodiments, five puzzle pieces 50 may be provided in each puzzle face 92. Accordingly, each puzzle piece 50 may have a triangular or wedge shape, as illustrated. The geometric puzzle 1 may have twenty puzzle pieces 50, which may form the respective faces of an icosahedron. In some embodiments, each puzzle piece 50, and other components described herein as being a "triangle" or "triangular", may be a reuleaux triangle. A reuleaux triangle is a curved triangle with constant width. The components of the puzzle core 2, the puzzle piece guides 24, the puzzle pieces 50, and other parts of the geometric puzzle 1 may be fabricated of plastic, metal, and/or other suitable materials using molding, casting, 3D printing, machining, milling, and/or other fabrication techniques known by those skilled in the art.

As further illustrated in FIGS. 7 and 8, the puzzle core 2 of the geometric puzzle 1 may have a spherical core wall 6. The core wall 6 may form a core interior 7. The core wall 6 may have an interior wall surface 10 which faces the core interior 7 and an exterior wall surface 11 opposite the interior wall surface 10. In some embodiments, flat or planar core indentations 8 may be provided in the interior wall surface 10 of the core wall 6. In embodiments in which the geometric puzzle 1 approximates the shape of the abstract dodecahedron 20, the core indentations 8 may be twelve in number.

A plurality of core openings 37 may extend through the core wall 6 of the puzzle core 2 from the interior wall surface 10 to the exterior wall surface 11. The core openings 37 may facilitate attachment of the respective puzzle piece guides 24 to the puzzle core 2, typically as will be hereinafter described. A line (not illustrated) which is perpendicular and centered on each pentagonal puzzle face 92 of the abstract dodecahedron 20 may point directly to the center of the core openings 37 which facilitate attachment of the puzzle piece guides 24 to the puzzle core 2.

Figure 11:
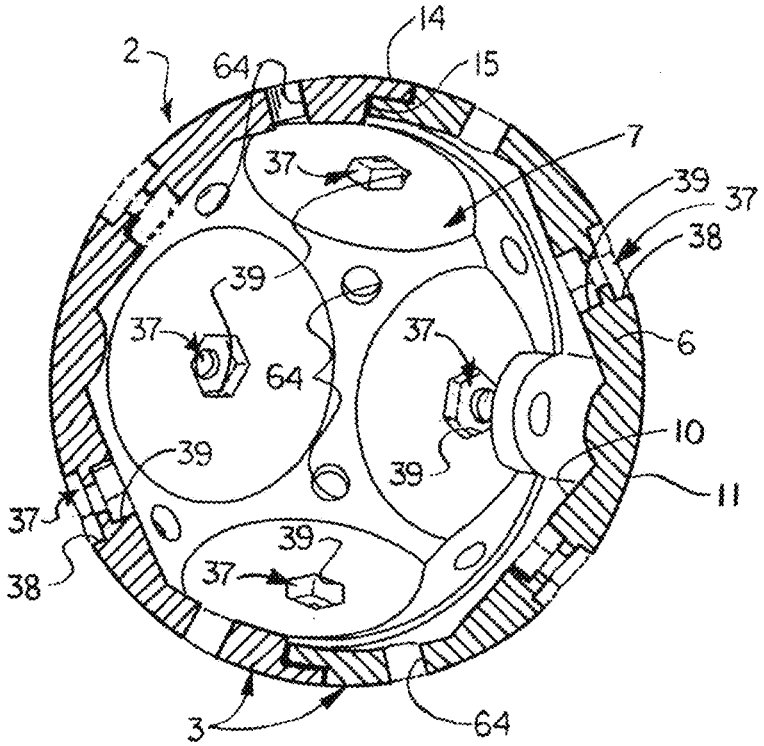
FIG. 11 is a cross-sectional view of a typical puzzle core of the illustrative geometric puzzle, the puzzle core having a pair of interfacing core subunits.

As illustrated in FIG. 11, each core opening 37 in the puzzle core 2 may have a post mount cavity 38 in the exterior wall surface 11 and a nut cavity 39 in the interior wall surface 10 of the core wall 6, typically for purposes which will be hereinafter described. As illustrated in FIGS. 7 and 8, in some embodiments, each nut cavity 39 may recess into the center of a corresponding core indentation 8 in the interior wall surface 10 of the core wall 6. The core openings 37 and puzzle piece guides 24 attached to the puzzle core 2 thereby may form or correspond positionally to the centers of the respective puzzle faces 92 on the geometric puzzle 1. In embodiments in which the geometric puzzle 1 approximates the shape of the abstract dodecahedron 20, the puzzle piece guides 24 may be tangential to the respective faces of the dodecahedron.

A plurality of core magnet openings 64, the purpose of which will be hereinafter described, may extend through the core wall 6 of the puzzle core 2. The core magnet openings 64 may correspond in number and position to the respective puzzle pieces 50 in the respective resting positions of each puzzle face 92. The 20 points or vertices of the abstract dodecahedron 20 formed by the puzzle faces 92 may be tangent to the surface of the puzzle core 2 and correspond to the locations or positions at which the core magnet openings 64 are placed in the puzzle core 2.

As further illustrated in FIGS. 7 and 8, in some embodiments, the puzzle core 2 of the puzzle 1 may include a pair of interfacing hemispherical core subunits 3. The core subunits 3 may be suitably configured to facilitate interlocking attachment of the core subunits 3 to each other to form or assemble the puzzle core 2. For example and without limitation, in some embodiments, an annular core subunit lip 14 may extend from one of the core subunits 3. An annular core subunit groove 15 may be provided in the other core subunit 3. The core subunit lip 14 may be suitably sized and configured to interface with the core subunit groove 15 in interlocking engagement of the core subunits 3 to each other. At least one pair of interfacing core subunit flanges 16 may extend from the respective core subunits 3. At least one subunit fastener (not illustrated) may engage the core subunit flanges 16 to secure the core subunit flanges 16 to each other in the assembled puzzle core 2. In some embodiments, the puzzle core 2 may be fabricated as a single unitary piece typically according to the knowledge of those skilled in the art.

In some embodiments, each puzzle piece guide 24 may include a guide member mount post 32. The guide member mount post 32 may be suitably sized and configured to engage a corresponding core opening 37 in the core wall 6 of the puzzle core 2, typically as will be hereinafter described. A guide member 25 may be supported by the guide member mount post 32. Each puzzle piece 50 in each puzzle face 92 of the geometric puzzle 1 may be configured to engage the guide member 25 as the puzzle piece 50 revolves around or with respect to the center puzzle piece guide 24 in its puzzle face 92 and detachably engage the guide member 25 as the puzzle piece 50 is transferred to an adjacent puzzle face 92.

A guide member mount fastener 40 may facilitate attachment of each guide member 25 to the core subunit 3, typically via the guide member mount post 32, at each corresponding core opening 37. In some embodiments, the guide member mount fastener 40 may include a threaded fastener bolt 41 and a fastener nut 42 threaded on the fastener bolt 41.

The guide member 25 of each puzzle piece guide 24 may have a circular disc shape with an inner guide member surface 27 which faces the exterior wall surface 11 of the core wall 6 and an outer guide member surface 28 which is opposite the inner guide member surface 27. The guide member mount post 32 may extend from the inner guide member surface 27. A guide member cavity 29 may extend into the outer guide member surface 28 of the guide member 25. Each puzzle piece 50 may be configured to detachably engage the guide member 25 typically at the inner surface of the guide member cavity 29 to facilitate revolution of the puzzle pieces 50 around the corresponding center puzzle piece guide 24 as the corresponding puzzle face 92 is rotated, typically as will be hereinafter described.

As illustrated in FIG. 8, in some embodiments, the guide member mount post 32 of each guide member 25 may include an outer post segment 33 which extends from the inner guide member surface 27. An inner post segment 34 may extend from the outer post segment 33. A post nut 35 may terminate the inner post segment 34. The post mount cavity 38 in each core opening 37 in the core wall 6 of the puzzle core 2 may be suitably sized and configured to accommodate the post nut 35 on the inner post segment 34 of each corresponding guide member mount post 32. For example and without limitation, each post mount cavity 38 may have a pentagonal shape and each post nut 35 may each have a hexagonal shape, as illustrated, although either or both may have some other polygonal shape.

Figure 12:
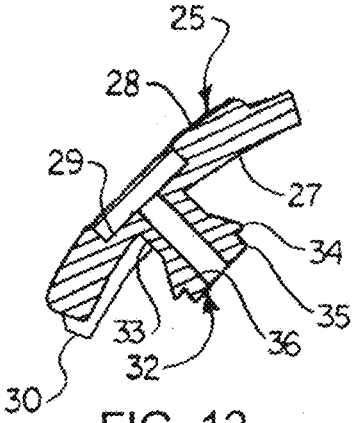
FIG. 12 is a cross-sectional view of a typical guide member of each puzzle piece guide.
Figure 15:
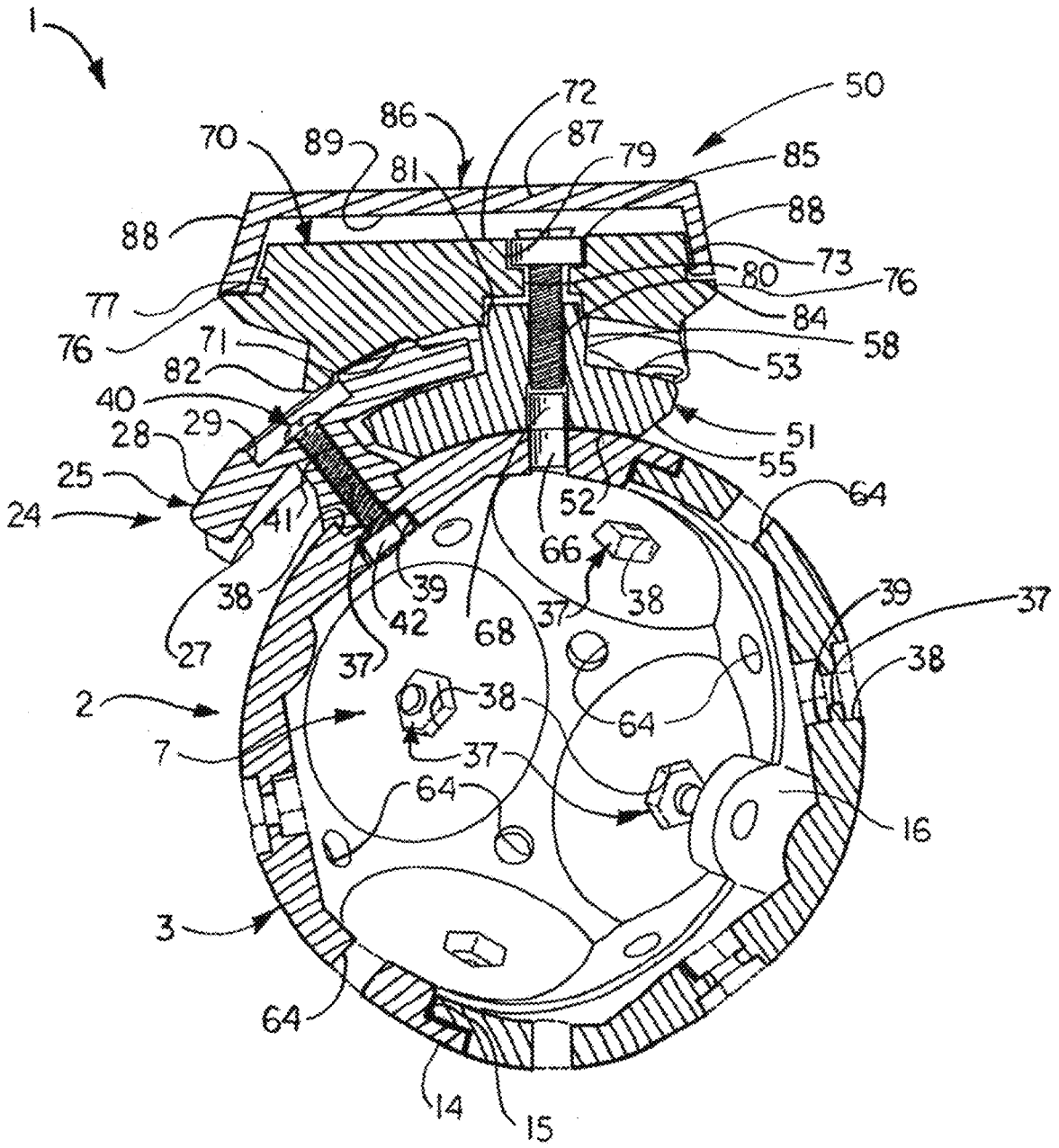
FIG. 15 is a cross-sectional view of the puzzle core with each puzzle piece guide and each puzzle piece assembled on the puzzle core according to an illustrative embodiment of the geometric puzzles.

As illustrated in FIG. 12, a guide member opening 36 may extend longitudinally through the guide member mount post 32 of each guide member 25. The guide member opening 36 may communicate with the guide member cavity 29 in the outer guide member surface 28 of the guide member 25. Accordingly, as illustrated in FIG. 15, the guide member 25 of each puzzle piece guide 24 may be attached to the puzzle core 2 by extending the fastener bolt 41 of the guide member mount fastener 40 through the guide member opening 36 (FIG. 12) in the guide member mount post 32 and through the registering post mount cavity 38 and nut cavity 39 of each core opening 37. The nut cavity 39 of each core opening 37 may be suitably sized and configured to accommodate the fastener nut 42 which is threaded on the post mount bolt 41 of the post mount fastener 40 to secure the guide member 25 to the puzzle core 2. In some embodiments, the fastener nut 42 may be fixedly mounted with respect to the core wall 6, typically according to the knowledge of those skilled in the art.

Figure 18:
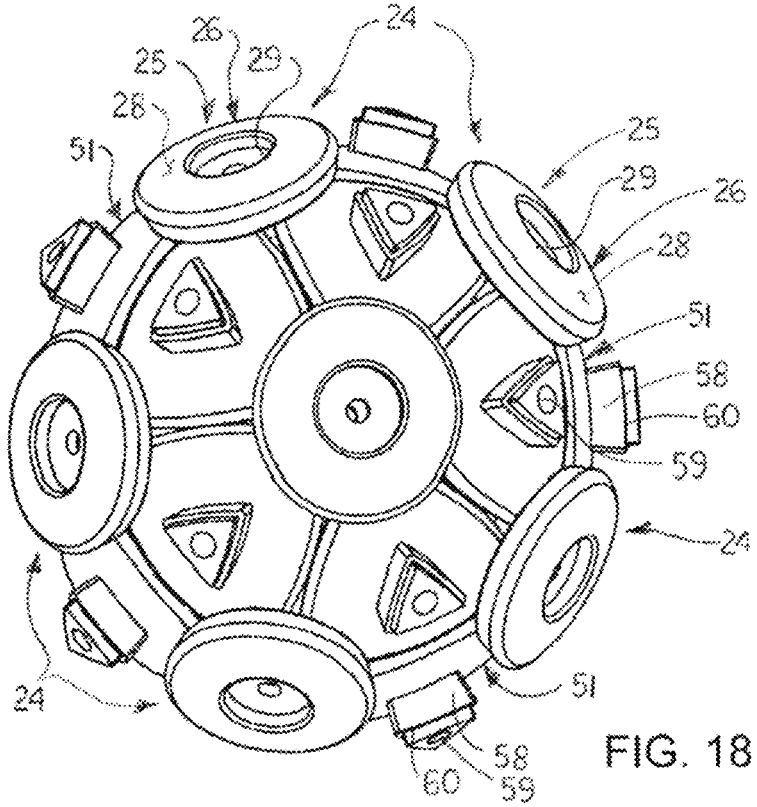
FIG. 18 is a perspective view illustrating multiple puzzle piece guides assembled on the puzzle core, each puzzle piece guide having a guide member of alternative design, and the partially assembled puzzle pieces engaging each puzzle piece guide.
Figure 19:
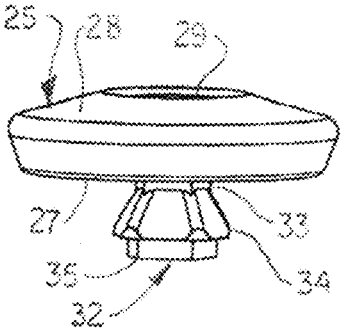
FIG. 19 is a perspective view of the guide member of each puzzle piece guide illustrated in FIG. 18.

As illustrated in FIGS. 7-10, in some embodiments, a guide member flange 30 may extend circumferentially outwardly from the guide member 25 of the of the puzzle piece guide 24. The guide member flange 30 may be pentagonal, as illustrated, with the sides of the pentagon typically facing the respective adjacent puzzle piece guides 24. The puzzle piece base 51 of each puzzle piece 50 may be configured to ride up against and along the guide member flange 30 as the puzzle pieces 50 transition between the resting positions and the rotated positions. As illustrated in FIGS. 18 and 19, in some embodiments, the guide member flange 30 may be omitted from the guide member 25.

Figure 20:
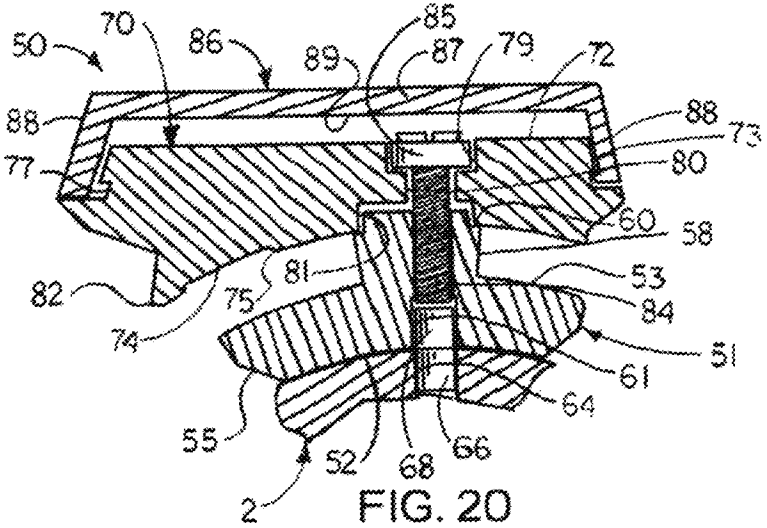
FIG. 20 is a sectional view of a puzzle piece deployed in the resting position of its puzzle face on the puzzle core, with a puzzle piece magnet in the puzzle piece base of the puzzle piece magnetically interfacing with a core magnet in the puzzle core to normally secure the puzzle piece in the resting position.

As illustrated in FIGS. 15 and 20, in some embodiments, a core magnet 66 may be supported by the spherical puzzle core 2 at each puzzle piece 50. Each core magnet 66 may be inserted or seated in each corresponding core magnet opening 64 in the core wall 6 of the puzzle core 2. The centers of the core magnet openings 64 in the puzzle core 2 may be located at the respective tangent points of the abstract dodecahedron 20 and exterior wall surface 11 of the core wall 6 such that the top of each core magnet 66 rests on the even exterior wall surface 11 of the core wall 6.

Figure 21:
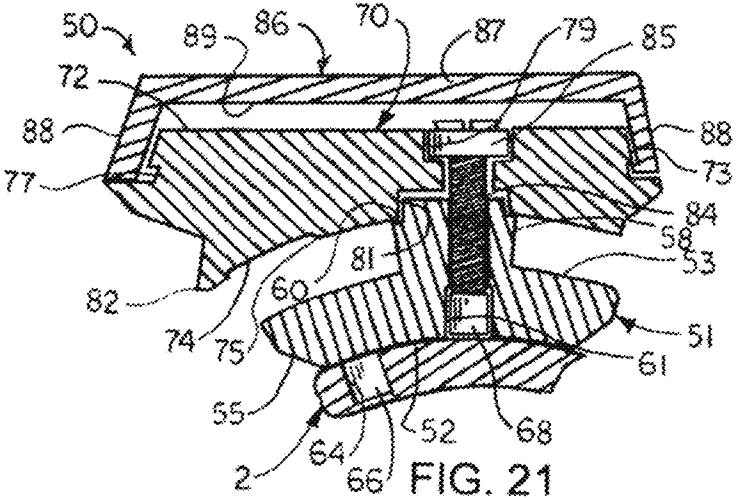
FIG. 21 is a sectional view of the puzzle piece illustrated in FIG. 20, with the puzzle piece magnet in the puzzle piece base of the puzzle piece magnetically disengaged from the core magnet in the puzzle core and engaged to the metal fastener upon rotation of the puzzle piece from the resting position to a rotated position between resting positions.

A puzzle piece magnet 68 may be provided in a magnet cavity 61 in each puzzle piece 50. In each resting position of each puzzle piece 50, the puzzle piece magnet 68 may magnetically interface with the core magnet 66, as illustrated in FIG. 20, to secure each puzzle piece 50 in a resting position. In each rotated position of each puzzle piece 50, the puzzle piece magnet 68 may magnetically disengage the core magnet 66 and is free to engage with a typically metal puzzle piece fastener 84, as illustrated in FIG. 21.

As illustrated in FIGS. 7 and 8, in some embodiments, each core magnet 66 and each puzzle piece magnet 68 may be cylindrical. The respective poles of each core magnet 66 and each puzzle piece magnet 68 may be disposed at the ends of each. Accordingly, as illustrated in FIG. 20, in each resting position of each puzzle piece 50, the opposite poles of the core magnet 66 and the puzzle piece magnet 68 may magnetically interface with each other. As illustrated in FIG. 21, in each rotated position of each puzzle piece 50, the opposite poles of the core magnet 66 and the puzzle piece magnet 68 may magnetically disengage from each other.

As illustrated in FIGS. 7, 8 and 15, in some embodiments, each puzzle piece 50 may include a puzzle piece base 51. The puzzle piece base 51 may have an inner base surface 52 which faces the exterior wall surface 11 of the core wall 6 and an outer base surface 53 opposite the inner base surface 52. The inner base surface 52 and the outer base surface 53 of the puzzle base 51 may be concentric to the puzzle core 2. In some embodiments, each puzzle piece 50 may be triangular. Accordingly, the puzzle piece base 51 may be triangular with three base edges 54. In the resting position of the puzzle piece 50, the points of the puzzle piece base 51 may point to the guide member mount posts 32 of adjacent puzzle piece guides 24. A base bevel 55 may be provided in each base edge 54 at the inner base surface 52.

As illustrated in FIG. 15, in the assembled puzzle piece 50, a portion of the puzzle piece base 51 may be sandwiched or interposed between the exterior wall surface 11 of the core wall 6 and the inner guide member surface 27 of the guide member 25 of the puzzle piece guide 24. The height or thickness of the puzzle piece base 51 may enable the puzzle piece base 51 to fit under the guide member 25 such as to sufficiently enable the puzzle piece base 51 to smoothly skirt under the guide member 25 as the puzzle pieces 50 revolve about the center puzzle piece guide 24. The base bevel 55 may prevent the puzzle piece base 51 from striking or engaging the guide member mount post 32 of the puzzle piece guide 24 as the puzzle face 92 is rotated.

Each puzzle piece 50 may include a guide engaging member 70 supported by the puzzle piece base 51. Each guide engaging member 70 may have an inner engaging member surface 71 which faces the outer base surface 53 of the puzzle piece base 51 and an outer engaging member surface 72 opposite the inner engaging member surface 71. In some embodiments, the guide engaging member 70 may be triangular with three engaging member sides 73. The guide engaging member sides 73 of the guide engaging member 70 may generally correspond in position to the respective base edges 54 of the puzzle piece base 51.

In some embodiments, a base extension 58 may protrude from the outer base surface 53 of the puzzle piece base 51. A base extension cavity 81 (FIG. 8) may extend into the inner engaging member surface 71 of the guide engaging member 70. The base extension cavity 81 may be suitably sized and configured to loosely accommodate the base extension 58. Accordingly, in the assembled puzzle piece 50, the base extension 58 may facilitate centering of the guide engaging member 70 on the puzzle piece base 51. The typically relative larger size of the base extension cavity 81 may facilitate up and down (inward and outward) movement of the puzzle piece base 51 with respect to the guide engaging member 70 without the base extension 58 engaging the shoulder in the base extension cavity 81 in the guide engaging member 70 or moving so low as to drop below the bottom of the puzzle piece base 51. Moreover, the typically reuleaux triangular shape of the base extension 58 may maintain the guide engaging member 70 in its correct orientation while allowing the guide engaging member 70 to toggle while moving in its own plane between the resting positions and the rotated positions of the puzzle piece 50.

A plurality of guide legs 82 may extend from the inner engaging member surface 71 of the guide engaging member 70. The guide legs 82 may generally correspond in position to the respective outer puzzle piece vertices 56 and inner puzzle piece vertex 57 (FIGS. 6, 24 and 25) of each puzzle piece 50. The guide legs 82 on the guide engaging member 70 of each puzzle piece 50 may be angled, and their sides may lie on the planes or faces of the abstract dodecahedron 20 to allow the guide legs 82 to ride along the beneath the guide engaging members 70 of the adjacent puzzle pieces 50 as they are in motion to provide additional support to the puzzle pieces 50. In each resting position of each puzzle piece 50, each guide tab 82 may engage or "snap into" the guide member cavity 29 in the guide member 25 of a center puzzle piece guide 24*a* (FIG. 6) at a corresponding puzzle face 92 of the geometric puzzle 1. The guide engaging members 70 of the puzzle pieces 50 which form each puzzle face 92 may share the same center puzzle piece guide 24*a* and sit on the plane which defines a corresponding face of the abstract dodecahedron 20. Accordingly, each of the 60 points of the guide engaging members 70 of the respective puzzle pieces 50 may be circled directly about a center of a guide member 25 of a corresponding puzzle piece guide 24. As a puzzle face 92 on which the puzzle piece 50 appears is rotated from a resting position to a rotated position, the guide tab 82 which corresponds in position to the inner puzzle piece vertex 57 of each puzzle piece 50 in the rotating puzzle face 92 may remain engaged with the guide member 25 of the center puzzle piece guide 24*a* at the center of the puzzle face 92, with the guide legs 82 of the respective puzzle pieces 50 abutted together or adjacent to each other on the same guide member 25. On the other hand, the guide legs 82 at the respective outer puzzle piece vertices 56 of each puzzle piece 50 in the puzzle face 92 may first disengage the inner surfaces of the guide member cavities 29 in the guide members 25 of the respective outer puzzle piece guides 24*b* and then engage or snap into the guide member cavities 29 in the guide members 25 of the next succeeding adjacent outer puzzle piece guides 24*b* at the outer edge of the puzzle face 92 of the geometric puzzle 1. As each guide tab 82 disengages the guide member cavity 29 and glides across the adjacent outer guide member surface 28 of the guide member 25, the outer guide member surface 28 may raise or lift the puzzle piece 50 as the puzzle piece 50 transitions between the resting and rotated positions.

Figure 23:
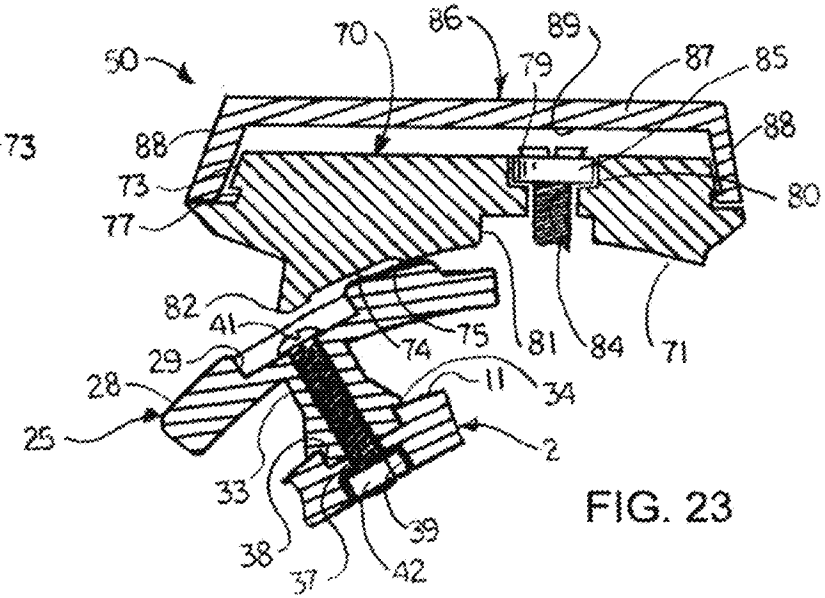
FIG. 23 is a sectional view of the guide engaging member and the puzzle piece cap of the puzzle piece illustrated in FIG. 22, with the guide engaging member of the puzzle piece disengaging the guide member of the puzzle piece guide as the puzzle piece is rotated from its resting position to a rotated position between resting positions.
Figure 22:
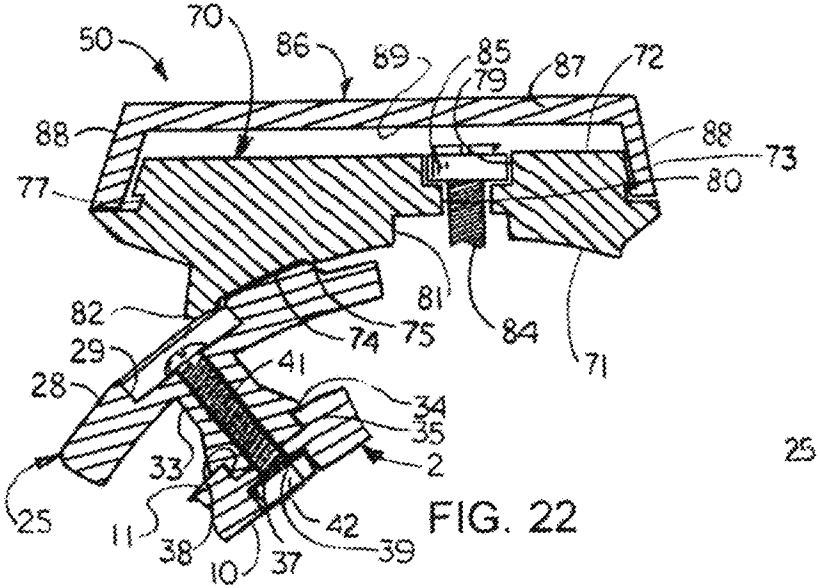
FIG. 22 is a sectional view of the guide engaging member and the puzzle piece cap of a puzzle piece, with the guide engaging member of the puzzle piece engaging a guide member (also in section) of a puzzle piece guide in the resting position of the puzzle piece.

As illustrated in FIGS. 20-23, a guide engaging surface 74, having a retaining edge 75, may be provided in the inner engaging member surface 71 of the guide engaging member 70 adjacent to each guide leg 82. As illustrated in FIG. 22, when the puzzle piece 50 is in a resting position, the guide engaging surface 74 may engage the outer guide member surface 28 of the guide member 25. The retaining edge 75 may engage the outer edge of the guide member 25 to maintain the guide engaging member 70 in place against the guide member 25. The outer edge of the guide member 25 may be curved to facilitate a smooth transition as the retaining edge 75 and the adjacent portion of the inner engaging member surface 71 of the guide engaging member 70 ride up onto the outer guide member surface 28 of the guide member 25 in order to lift the guide legs 82 from the guide member cavity 29 of the guide member 25, as illustrated in FIG. 23. As the puzzle piece 50 transitions from each resting position through a rotated position to another resting position, the relatively lower surface of the inner engaging member surface 71 adjacent to the retaining edge 75 may raise two of the guide legs 82, allowing the third guide leg 82 on the guide engaging member 70 to turn slightly down into the guide member cavity 29 in the guide member 25 of its corresponding puzzle piece guide 24 and into a favorable position to traverse the inner wall of the guide member cavity 29 during revolution around the center puzzle piece guide 24*a*.

By alternately, sequentially, and incrementally rotating adjacent puzzle faces 92 in convert on the geometric puzzle 1 in the foregoing manner, puzzle pieces 50 may be transferred or exchanged among or between the puzzle faces 92 to attain selected combinations of the visual patterns 94 on the puzzle pieces 50 in each puzzle face 92 typically for the purpose of scrambling and then matching the visual patterns 94 on the puzzle pieces 50 in one or more of the puzzle faces 92. Each puzzle face 92 may be rotated incrementally as the puzzle pieces 50 in that puzzle face 92, initially disposed in a resting position, first disengage the outer puzzle piece guides 24*b*, transition through a rotating position and then reengage the respective adjacent outer puzzle piece guides 24*b* at the respective outer puzzle piece vertices 56 on the outer edge of the puzzle face 92 in another resting position. The puzzle face 92 may thus generate a clicking feel and sound each time the puzzle pieces 50 in the puzzle face 92 reengage the respective outer puzzle piece guides 24*b* throughout incremental rotation of the puzzle face 92 through the respective resting positions and intervening rotating positions of the puzzle pieces 50.

Figure 13:
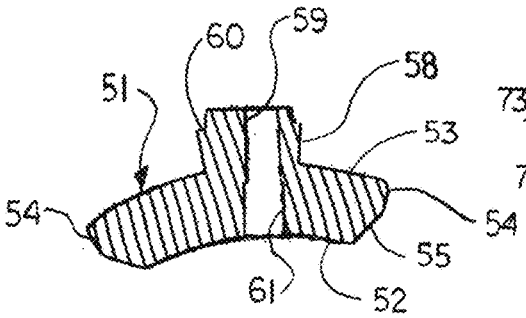
FIG. 13 is a cross-sectional view of a typical puzzle piece base of each puzzle piece.
Figure 14:
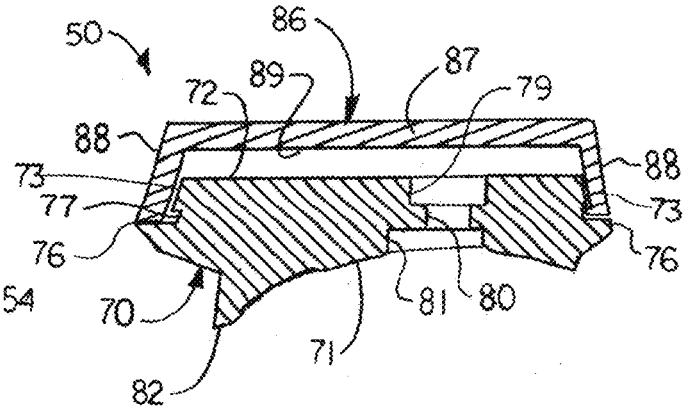
FIG. 14 is a cross-sectional view of a typical guide engaging member and puzzle piece cap of each puzzle piece.

As illustrated in FIG. 13, a fastener opening 59 may extend through the puzzle piece base 51 and the base extension 58 of each puzzle piece 50. As illustrated in FIG. 14, a fastener opening 80 may in like manner extend through the guide engaging member 70. As illustrated in FIG. 7, the fastener opening 59 in the puzzle piece base 51 and the fastener opening 80 in the guide engaging member 70 may be suitably sized and configured to receive and accommodate the puzzle piece fastener 84, which may facilitate attachment of the guide engaging member 70 to the puzzle piece base 51. The puzzle piece fastener 84 may be configured to move freely within the fastener opening 80 but may be tightly attached to the puzzle piece base 51 above and adjacent to the puzzle piece magnet 68 to contact the puzzle piece magnet 68. The puzzle piece fastener 84 may be made of a paramagnetic metal or other material, thereby allowing the puzzle piece magnet 68 to move freely in the magnet cavity 61 to disengage the core magnet 66 and engage the puzzle piece fastener 84 as the puzzle piece 50 moves from a resting position through a rotated position. The polar action of the magnet-to-magnet attraction may be stronger than that of the magnet-to-fastener attraction, thus allowing the puzzle piece magnet 68 to jump from the core magnet 66 to the puzzle piece fastener 84 as the puzzle piece 50 moves from a resting position to a rotated position but return to the core magnet 66 as the puzzle piece 50 deploys from the rotated position to the same or another resting position. In each resting position, the strong pull of polarity of the core magnet 66 and the puzzle piece magnet 68 may magnetically pull the puzzle pieces 50 in place on the puzzle core 2. As illustrated in FIGS. 8 and 13, the lower or inner end of the fastener opening 59 may include the magnet cavity 61 which may extend into the inner base surface 52 of the puzzle piece base 51. The magnet cavity 61 may be sized and configured to accommodate the puzzle piece magnet 68. The magnet cavity 61 may enable the puzzle piece magnet 68 to move up and down freely and yet remain in an upright position within the magnet cavity 61 as the puzzle face 92 is rotated.

As further illustrated in FIG. 14, the fastener opening 80 may include a membrane cavity 79 which may extend into the outer engaging member surface 72 of the guide engaging member 70. The membrane cavity 79 may be suitably sized and configured to receive and accommodate a resilient membrane 85 (FIGS. 7 and 8) which may encircle the puzzle piece fastener 84. The membrane 85 may be configured to act as a spring which allows the guide engaging member 70 to raise up and/or toggle, as needed, as the guide engaging member 70 rides up onto the guide member 25 of the puzzle piece guide 24, as illustrated in FIG. 23, during movement of the puzzle piece 50. The fastener opening 80 may further include a base extension cavity 81 which may extend into the inner engaging member surface 71 of the guide engaging member 70. The base extension cavity 81 may be suitably sized and configured to receive and accommodate the base extension 58 of the puzzle piece base 51. In some embodiments, the base extension 58 and the base extension cavity 81 may each have a triangular cross-section, as illustrated in FIG. 7. The base extension 58 may have a base extension shoulder 60 which seats against a shoulder (not numbered) in the base extension cavity 81 of the guide engaging member 70, as illustrated in FIG. 20.

As illustrated in FIGS. 7, 8, 14 and 15, a puzzle piece cap 86 may be supported by the guide engaging member 70 of each puzzle piece 50. In some embodiments, the puzzle piece cap 86 may be an isosceles triangle. Accordingly, the puzzle piece caps 86 of the respective puzzle pieces 50 of the geometric puzzle 1 may form respective faces of an icosahedron with notches between the triangles forming the plane on which the puzzle piece caps 86 turn in movement of the puzzle pieces 50.

The puzzle piece cap 86 of each puzzle piece 50 may have a triangular cap outer wall 87. The cap outer walls 87 of the puzzle pieces 50 may correspond to the planes or faces of the abstract dodecahedron 20. Three cap side walls 88 may extend from the respective edges of the cap outer wall 87. As illustrated in FIG. 8, a cap interior 89 may be formed by and between the cap outer wall 87 and the cap side walls 88. As illustrated in FIG. 14, the cap interior 89 may be suitably sized and configured to accommodate at least an upper or outer portion of the guide engaging member 70. The cap interior 89 may additionally provide space which facilitates up and down movement of the puzzle piece fastener 84 within the fastener opening 80 in the puzzle piece 50 and may additionally facilitate selective adjustment of the puzzle piece fastener 84 to selected heights for optimum tension, typically as will be hereinafter described.

In some embodiments, the puzzle piece cap 86 may be detachably attached to the guide engaging member 70 of each puzzle piece 50 typically according to the knowledge of those skilled in the art. Accordingly, as illustrated in FIG. 14, in some embodiments, engaging member flanges 76 may extend from the respective engaging member sides 73 of the guide engaging member 70. An indentation 77 may be provided in each engaging member side 73 adjacent to the engaging member flange 76. The cap side walls 88 of the puzzle piece cap 86 may overhang and snap into the respective indentations 77 to detachably secure the puzzle piece cap 86 on the guide engaging member 70. The puzzle piece cap 86 may thus be selectively removable from the underlying guide engaging member 70 to facilitate access to the puzzle piece fastener 84 for adjustment of the tension of the guide engaging member 70 on the puzzle piece base 51, resetting of the geometric puzzle 1 by rearrangement of the puzzle piece caps 86 on the puzzle pieces 50, and/or to exchange the puzzle piece caps 86 with other puzzle piece caps 86 having alternate puzzle designs or visual patterns 94 thereon. In other techniques for detachably attaching the puzzle piece cap 86 to the guide engaging member 70, a cap fastener opening (not illustrated) may be provided in the cap outer wall 87 of the puzzle piece cap 86. The length of the puzzle piece fastener 84 may be extended such that the fastener 84 extends through the cap fastener opening and engages the upper surface of the cap outer wall 87. A sticker (not illustrated) may be applied over the exposed fastener 84 to conceal the fastener 84 from view. In some embodiments, the guide engaging member 70 and the puzzle piece cap 86 may be fabricated in one piece.

Figure 16:
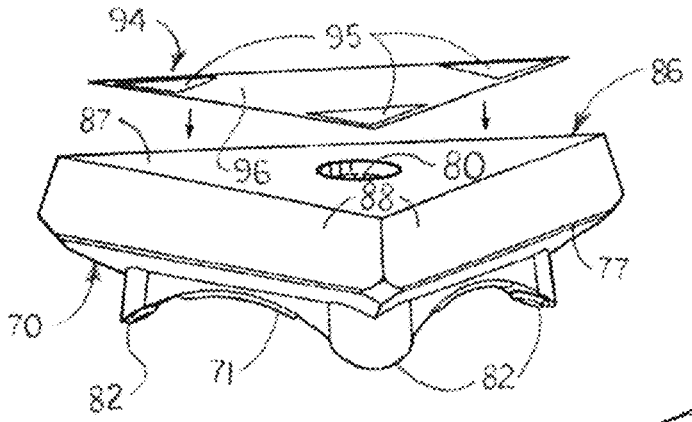
FIG. 16 is an exploded perspective view of an example of a combination of the guide engaging member and puzzle piece cap of each puzzle piece formed into one completed piece and an adhesive application of a pattern carrying panel to the flat or planar top of the outer piece and covering the opening 80 for the fastener 84, the pattern carrying panel having a visual pattern including multiple triangular tabs.
Figure 17:
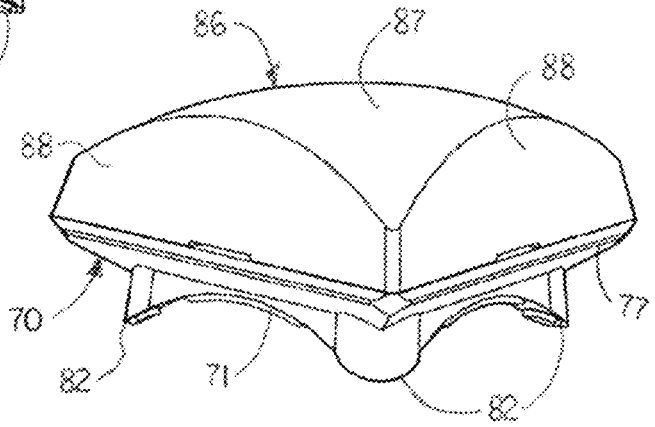
FIG. 17 is a perspective view of a guide engaging member with a puzzle piece cap having a cap outer wall with an alternative, convex shape on the guide engaging member.
Figure 27:
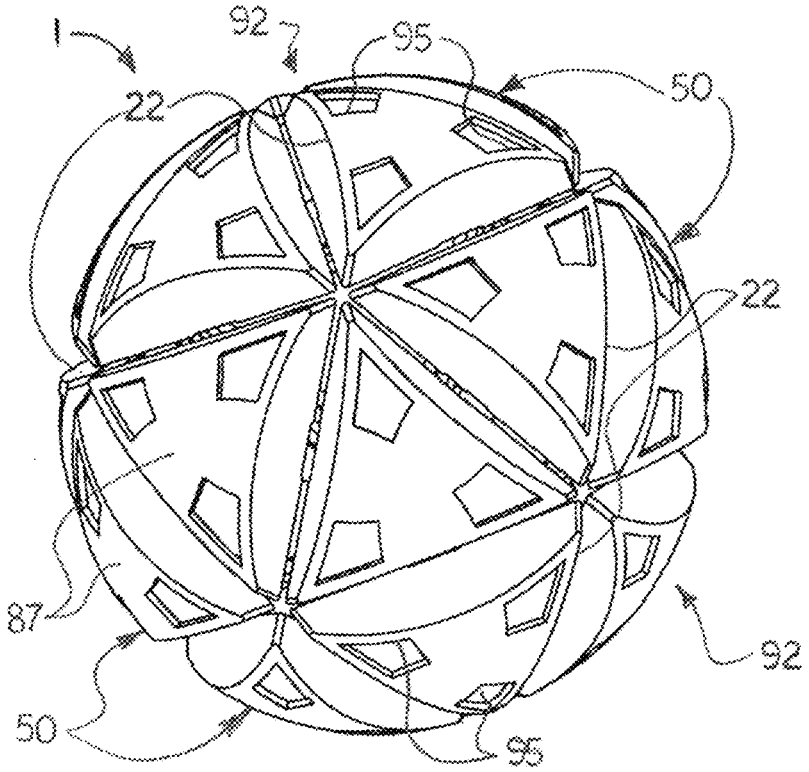
FIG. 27 is a perspective view of an illustrative spherical embodiment of the geometric puzzles.

The visual pattern 94 may be applied to the cap outer wall 87 of each puzzle piece cap 86 using any suitable technique which is known by those skilled in the art. Accordingly, in some embodiments, the visual pattern 94 may be molded, casted or shaped into the cap outer wall 87 or stamped, painted on, or otherwise applied to the cap outer wall 87. As illustrated in FIG. 16, in some embodiments, the visual pattern 94 may be provided on an adhesive pattern carrying panel 96. The pattern carrying panel 96 may be adhesively applied to the outer surface of the cap outer wall 87, as illustrated. As illustrated in FIG. 17, the cap outer wall 87 of the puzzle piece cap 86 may have a raised or convex profile, as illustrated, or any alternative shape or profile. For example and without limitation, as illustrated in FIG. 27, in some embodiments, the geometric puzzle 1 may be a sphere with notches 22 cut into the sphere at points which correspond to the planes of the abstract dodecahedron 20, defined by the cap outer walls 87 of the puzzle pieces 50 in the respective puzzle faces 92.

In typical application, the geometric puzzle 1 may be solved by alphabetical, numerical, symbolic, pictorial, color and/or other matching of the visual patterns 94 on the respective puzzle pieces 50 on one or more of the puzzle faces 92. Accordingly, the visual patterns 94 on the puzzle pieces 50 on the puzzle face(s) 92 may initially be scrambled typically by dispersing the puzzle pieces 50 among the puzzle faces 92. As illustrated in FIGS. 1-4, this may be accomplished by alternately, incrementally, and sequentially rotating the puzzle faces 92 in concert with each other around the respective center puzzle piece guides 24*a* (FIG. 6) to transfer or exchange the puzzle pieces 50 among or between the puzzle faces 92 and attain different combinations of the visual patterns 94 on the puzzle pieces 50 in each puzzle face 92. Each puzzle piece 50 may be rotated between the resting positions by incrementally revolving the puzzle pieces 50 around the center puzzle piece guide 24*a* of the corresponding puzzle face 92 as the puzzle pieces 50 deploy between the resting positions through the intervening rotated positions, typically as was heretofore described.

As illustrated in FIG. 6, in the resting or rotated positions of each puzzle face 92, the inner puzzle piece vertices 57 of the respective puzzle pieces 50 in the puzzle face 92 may initially be disposed over the guide member 25 of the corresponding center puzzle piece guide 24*a*, whereas each outer puzzle piece vertex 56 of each puzzle piece 50 in the puzzle face 92 may be disposed over a corresponding one of the outer puzzle piece guides 24*b* which are spaced-apart around the outer edge of the puzzle face 92, with the outer puzzle piece vertices 56 of adjacent puzzle pieces 50 sharing the same outer puzzle piece guide 24*b*. A second puzzle face 92 which is adjacent to a first puzzle face 92 may be rotated to transfer one or more of the puzzle pieces 50 from the first puzzle face 92 to the adjacent second puzzle face 92 as the puzzle pieces 50 in the first puzzle face 92 initially disengage the center puzzle piece guide 24*a* of the first puzzle face 92 and then engage an outer puzzle piece guide 24*b* which is adjacent to the center puzzle piece guide 24*a*. The formerly outer puzzle piece guide 24*b* then becomes the center puzzle piece guide 24*a* of the second puzzle face 92, which has a new combination of puzzle pieces 50 with different visual patterns 94 on the puzzle pieces 50. In the foregoing manner, the puzzle faces 92 can be rotated to facilitate uniform or homogenous dispersal and mixture of the puzzle pieces 50 among the puzzle faces 92 on the geometric puzzle 1. The same procedure of rotating the puzzle faces 92 can be repeated to attain matching of the visual patterns 94 on the puzzle pieces 50 in one or more of the puzzle faces 92.

In FIG. 24, a typical example of a first puzzle face 92*a* having puzzle pieces 50 with tabs 95*a-f* in the visual patterns 94 on the puzzle pieces 50 in a scrambled or unmatched configuration is illustrated. The visual pattern 94 on each puzzle piece 50 is unique for each piece and includes tabs 95*a*, 95*b*, 95*c*, 95*d*, 95*e*, 95*f* having different visual characteristics, In FIG. 25, a second puzzle face 92*b* has been attained by revolving the scrambled puzzle pieces 50 of the first puzzle face 92*a* illustrated in FIG. 24 and, in some cases, other puzzle faces 92 in the geometric puzzle 1, about the central axis of rotation 46 (which corresponds to the center puzzle piece guide 24*a*, FIG. 6) of the first puzzle face 92*a* and each other puzzle face 92. The puzzle pieces 50 have been transferred or exchanged with puzzle pieces 50 among the first puzzle face 92*a* and other puzzle faces 92 in the geometric puzzle 1. In the new second puzzle face 92*b*, the first tabs 95*a* at the inner puzzle piece vertices 57 of the respective puzzle pieces 50 match each other, whereas the remaining tabs on vertices 56 are paired up with the matching tabs on the adjacent puzzle pieces on their own common vertex. Each pair 95*b*, 95*c*, 95*d*, 95*e*, and 95*f* would now establish the identifying pattern for the 5 surrounding axis points of the 95*a* pattern axis. It is only by this configuration that the arranged 95*a* tabs and the 5 puzzle pieces would be considered correct in their orientation.

While certain illustrative embodiments of the disclosure have been described above, it will be recognized and understood that various modifications can be made to the embodiments and the appended claims are intended to cover all such modifications which may fall within the spirit and scope of the disclosure.

I claim:

1. A geometric puzzle, comprising:

a puzzle core;

a plurality of independently rotatable puzzle faces on the puzzle core, each of the plurality of independently rotatable puzzle faces comprising:

a puzzle piece guide supported by the puzzle core, the puzzle piece guide forming a central axis of rotation of each corresponding one of the plurality of independently rotatable puzzle faces;

a plurality of puzzle pieces supported by the puzzle core, the plurality of puzzle pieces concentrically arranged around, detachably engaging and revolvable about the puzzle piece guide;

wherein the puzzle piece guide comprises a guide member mount post carried by the puzzle core and a guide member carried by the guide member mount post, and each of the plurality of puzzle pieces is configured to detachably engage the guide member;

a guide member cavity in the guide member, and wherein the each of the plurality of puzzle pieces detachably engages the guide member cavity; and at least one visual pattern on the each of the plurality of puzzle pieces; and the plurality of independently rotatable puzzle faces each rotatable by revolving the plurality of puzzle pieces about the puzzle piece guide of each corresponding one of the plurality of independently rotatable puzzle faces to transfer or exchange at least one of the plurality of puzzle pieces among or between the plurality of independently rotatable puzzle faces and attain selected combinations of the at least one visual pattern on each of the plurality of puzzle pieces in the each corresponding one of the plurality of independently rotatable puzzle faces for scrambling or matching of the at least one visual pattern on the each of the plurality of puzzle pieces with the at least one visual pattern on others of the plurality of puzzle pieces in the each corresponding one of the plurality of independently rotatable puzzle faces.

2. The geometric puzzle of claim 1 wherein each of the plurality of independently rotatable puzzle faces forms a corresponding face of a polyhedron.

3. The geometric puzzle of claim 2 wherein the polyhedron comprises a dodecahedron and the plurality of independently rotatable puzzle faces comprises twelve independently rotatable puzzle faces.

4. The geometric puzzle of claim 2 wherein the plurality of puzzle pieces in the each corresponding one of the plurality of independently rotatable puzzle faces comprises five triangular puzzle pieces in the each corresponding one of the plurality of independently rotatable puzzle faces.

5. The geometric puzzle of claim 1 further comprising a plurality of guide legs on the each of the plurality of puzzle pieces, and wherein one of the plurality of guide legs detachably engages the guide member cavity.

6. The geometric puzzle of claim 1 wherein the at least one visual pattern comprises at least one alphabetical, numerical, symbolic, pictorial, or color visual pattern.

7. A geometric puzzle, comprising:

a spherical puzzle core;

a plurality of independently rotatable puzzle faces on the spherical puzzle core, each of the plurality of independently rotatable puzzle faces disposable in a plurality of resting positions and a plurality of rotated positions between the plurality of resting positions, respectively, on the spherical puzzle core, each of the plurality of independently rotatable puzzle faces forming a corresponding face of a polyhedron and comprising:

a puzzle piece guide comprising a circular disc shaped guide member supported by the spherical puzzle core;

a plurality of puzzle pieces supported by the spherical puzzle core and concentrically arranged around and revolvable about the circular disc shaped guide member of the puzzle piece guide in concert with each other, each of the plurality of puzzle pieces comprising:

a puzzle piece base;

a guide engaging member supported by the puzzle piece base, the guide engaging member detachably engaging the circular disc shaped guide member of the puzzle piece guide;

a puzzle piece cap supported by the guide engaging member;

a core magnet supported by the spherical core;

a puzzle piece magnet on the puzzle piece base, the puzzle piece magnet magnetically interfacing with the core magnet in each corresponding one of the plurality of resting positions and magnetically disengaging the core magnet in each corresponding one of the plurality of rotated positions of the each corresponding one of the plurality of independently rotatable puzzle faces; and at least one visual pattern on the puzzle piece cap; and the plurality of independently rotatable puzzle faces each sequentially rotatable by incrementally revolving the plurality of puzzle pieces about the puzzle piece guide of each corresponding one of the plurality of independently rotatable puzzle faces between the plurality of rotated positions to the plurality of rested positions, respectively, to transfer or exchange at least one of the plurality of puzzle pieces among or between the plurality of independently rotatable puzzle faces and attain selected combinations of the at least one visual pattern on each of the plurality of puzzle pieces in the each corresponding one of the plurality of independently rotatable puzzle faces for scrambling or matching of the at least one visual pattern on the each of the plurality of puzzle pieces with the at least one visual pattern on others of the each of the plurality of puzzle pieces in the each corresponding one of the plurality of independently rotatable puzzle faces.

8. The geometric puzzle of claim 7 wherein the polyhedron comprises a dodecahedron and the plurality of independently rotatable puzzle faces comprises twelve independently rotatable puzzle faces.

9. The geometric puzzle of claim 8 wherein the plurality of puzzle pieces in the each corresponding one of the plurality of independently rotatable puzzle faces comprises five puzzle pieces in the each corresponding one of the plurality of independently rotatable puzzle faces.

10. The geometric puzzle of claim 7 wherein the each of the plurality of puzzle pieces is triangular.

11. The geometric puzzle of claim 7 further comprising a guide member cavity in the guide member, and wherein the each of the plurality of puzzle pieces detachably engages the guide member cavity.

12. The geometric puzzle of claim 11 further comprising a plurality of guide legs on the guide engaging member of each corresponding one of the plurality of puzzle pieces, and wherein one of the plurality of guide legs detachably engages the guide member cavity.

13. The geometric puzzle of claim 7 wherein the at least one visual pattern comprises at least one alphabetical, numerical, symbolic, pictorial, or color visual pattern.

14. A geometric puzzle, comprising:

a spherical puzzle core;

a plurality of core magnet openings in the spherical puzzle core;

twelve independently rotatable puzzle faces on the spherical puzzle core, each of the twelve independently rotatable puzzle faces incrementally disposable in a plurality of resting positions and a plurality of rotated positions between the plurality of resting positions, respectively, on the spherical puzzle core, the each of the twelve independently rotatable puzzle faces forming a corresponding face of a dodecahedron and comprising:

a puzzle piece guide comprising:

a guide member mount post supported by the spherical puzzle core, the guide member mount post of the puzzle piece guide forming a central axis of rotation of the each corresponding one of the twelve independently rotatable puzzle faces;

a circular disc shaped guide member supported by the guide member mount post; and a guide member cavity in the circular disc shaped guide member;

five puzzle pieces concentrically arranged around, detachably engaging and revolvable about the circular disc shaped guide member of the puzzle piece guide in concert with each other, each of the five puzzle pieces comprising:

a triangular puzzle piece base interposed between and slidable with respect to the spherical core and the circular disc shaped guide member of the puzzle piece guide;

a triangular guide engaging member supported by the triangular puzzle piece base, the triangular guide engaging member having a plurality of guide legs, wherein one of the plurality of guide legs detachably engages the guide member cavity in the circular disc shaped guide member of the puzzle piece guide;

a triangular puzzle piece cap supported by the triangular guide engaging member;

a core magnet in each corresponding one of the plurality of core magnet openings in the spherical core;

a puzzle piece magnet on the triangular puzzle piece base, the puzzle piece magnet magnetically interfacing with the core magnet in each corresponding one of the plurality of resting positions and magnetically disengaging the core magnet in each corresponding one of the plurality of rotated positions of the each corresponding one of the twelve independently rotatable puzzle faces; and at least one visual pattern on the triangular puzzle piece cap; and the twelve independently rotatable puzzle faces each sequentially rotatable by incrementally revolving the plurality of puzzle pieces about the puzzle piece guide of each corresponding one of the plurality of independently rotatable puzzle faces between the plurality of rotated positions to the plurality of rested positions, respectively, to transfer or exchange at least one of the plurality of puzzle pieces among or between the twelve independently rotatable puzzle faces and obtain selected combinations of the at least one visual pattern on the each of the plurality of puzzle pieces in the each corresponding one of the twelve independently rotatable puzzle faces for scrambling or matching of the at least one visual pattern on the each of the plurality of puzzle pieces with the at least one visual pattern on others of the plurality of puzzle pieces in the each corresponding one of the twelve independently rotatable puzzle faces.

15. The geometric puzzle of claim 14 wherein the puzzle core comprises a pair of interfacing hemispherical core subunits.

16. The geometric puzzle of claim 14 further comprising a pentagonal guide member flange extending circumferentially from the circular disc shaped guide member of the of the puzzle piece guide.

17. The geometric puzzle of claim 14 wherein the at least one visual pattern comprises at least one alphabetical, numerical, symbolic, pictorial, or color visual pattern.

18. The geometric puzzle of claim 17 further comprising a pattern carrying panel adhesively attached to the triangular puzzle piece cap, and wherein the at least one visual pattern is on the pattern carrying panel.

* * * * *